US011365092B2

(12) United States Patent
Sanchez Munoz

(10) Patent No.: US 11,365,092 B2
(45) Date of Patent: Jun. 21, 2022

(54) ELEVATOR SAFETY GEAR ACTUATION DEVICE

(71) Applicant: Otis Elevator Company, Farmington, CT (US)

(72) Inventor: Ruben Sanchez Munoz, Madrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 217 days.

(21) Appl. No.: 16/537,049

(22) Filed: Aug. 9, 2019

(65) Prior Publication Data

US 2020/0048042 A1 Feb. 13, 2020

(30) Foreign Application Priority Data

Aug. 10, 2018 (EP) ..... 18188532

(51) Int. Cl.
*B66B 5/18* (2006.01)
*B66B 5/00* (2006.01)
*B66B 5/22* (2006.01)

(52) U.S. Cl.
CPC ..... *B66B 5/18* (2013.01); *B66B 5/0087* (2013.01); *B66B 5/22* (2013.01)

(58) Field of Classification Search
CPC ..... B66B 5/18; B66B 5/22; B66B 5/0087; B66B 5/16; F16D 65/14
See application file for complete search history.

(56) References Cited

U.S. PATENT DOCUMENTS 5,109,958 A 5/1992 Kato et al.
5,434,549 A * 7/1995 Hirabayashi ..... H02K 33/00 335/229

(Continued)

FOREIGN PATENT DOCUMENTS

CN 106276672 B 4/2018
EP 3112306 A1 1/2017

(Continued)

OTHER PUBLICATIONS

Ferdinand Baldassarre, Electromagnetic Brake with Clamping Jaws, Dec. 15, 1989, machine translation of the description of FR 2632620 A1 (Year: 1989).*

(Continued)

*Primary Examiner* — Michael R Mansen
*Assistant Examiner* — Michelle M Lantrip
(74) *Attorney, Agent, or Firm* — Cantor Colburn LLP

(57) ABSTRACT

An actuation mechanism for an elevator safety gear comprises an engagement element, at least two permanent magnets and at least one electric coil. The engagement element is movable between an engaged position in which it engages with the guide member of the elevator system and a disengaged position in which it does not engage with the guide member of the elevator system. The at least two permanent magnets are arranged in a configuration generating a repulsive force ($F_R$) between the at least two permanent magnets and urging the engagement element towards the engaged position. The at least one electric coil is configured for generating an electromagnetic force urging the engagement element towards the disengaged position and/or for holding the engagement element in the disengaged position, when an electric current is flowing through the at least one electric coil.

14 Claims, 10 Drawing Sheets

(56) References Cited

U.S. PATENT DOCUMENTS 5,467,850 A 11/1995 Skalski
5,809,157 A * 9/1998 Grumazescu ..... H04R 9/063 310/13
6,040,752 A * 3/2000 Fisher ..... H01F 7/1615 335/229
6,147,422 A * 11/2000 Delson ..... H02K 23/00 273/148 R
6,471,017 B1 10/2002 Booz et al.
6,501,357 B2 * 12/2002 Petro ..... H01F 7/13 310/17
6,802,402 B2 10/2004 Bausch et al.
7,088,207 B2 * 8/2006 Siedelhofer ..... H01H 71/142 335/172
8,151,950 B2 4/2012 Fargo
8,157,060 B2 4/2012 Gremaud et al.
8,205,727 B2 6/2012 Berndt et al.
8,485,318 B2 * 7/2013 Doran ..... B66B 5/185 187/350
9,376,295 B2 6/2016 Piech et al.
9,688,512 B2 6/2017 West et al.
9,915,307 B2 3/2018 Piech et al.
2007/0272503 A1 * 11/2007 Kigawa ..... B66B 5/18 187/379
2012/0211311 A1 8/2012 Piech et al.
2015/0240894 A1 * 8/2015 Piech ..... F16D 63/008 188/163
2016/0039637 A1 * 2/2016 Momoki ..... B66B 11/08 187/254
2016/0236904 A1 * 8/2016 Witczak ..... B66B 5/22
2017/0001835 A1 1/2017 Hu et al.
2017/0129741 A1 * 5/2017 Hu ..... B66B 5/18
2017/0291793 A1 10/2017 Bitzi et al.
2017/0291794 A1 * 10/2017 Bitzi ..... B66B 1/32
2018/0186603 A1 * 7/2018 Virta ..... B66B 5/16

FOREIGN PATENT DOCUMENTS

FR 2632620 A1 * 12/1989 ..... B66B 5/18
JP 2001320868 A * 11/2001 ..... B66B 5/18
JP 4550602 B2 9/2010
WO 2015191695 A1 12/2015
WO WO-2017001052 A2 * 1/2017 ..... H01F 7/1615
WO 2017023926 A1 2/2017

OTHER PUBLICATIONS

European Search Report for application 18188532.8, Feb. 25, 2019, 8 pages.

* cited by examiner

ELEVATOR SAFETY GEAR ACTUATION DEVICE

This application claims priority to European Patent Application No. 18188532.8, filed Aug. 10, 2018, and all the benefits accruing therefrom under 35 U.S.C. § 119, the contents of which in its entirety are herein incorporated by reference.

BACKGROUND

The invention relates to an actuation device for an elevator safety gear (elevator safety gear actuation device) and to an elevator safety gear with such an actuation device. The invention further relates to an elevator car and to an elevator counterweight respectively comprising such an elevator safety gear, and to an elevator system comprising such an elevator car and/or such a counterweight.

An elevator system typically comprises at least one elevator car moving between a plurality of landings along a guide member extending in a hoistway, and a driving member configured for driving the elevator car. In particular embodiments, the elevator system may further include a counterweight moving concurrently and in opposite direction with respect to the elevator car. In order to ensure a safe operation, the elevator system further comprises at least one elevator safety gear which is configured for braking the movement of the elevator car and/or the movement of the counterweight relative to the guide member, such as a guide rail, in an emergency situation, in particular when the movement of the elevator car and/or of the counterweight exceeds a predetermined velocity or acceleration.

The elevator safety gear includes an actuation device which is configured for actuating the elevator safety gear.

It would be beneficial to provide an improved actuation device which ensures safe and reliable operation over a long time of operation and which needs less maintenance than a conventional actuation device.

SUMMARY

Exemplary embodiments of the invention include an actuation mechanism for an elevator safety gear, wherein the elevator safety gear is configured for braking an elevator car or a counterweight of an elevator system by engaging a braking member with a guide member of the elevator system. The actuation mechanism comprises an engagement element, which is movable between an engaged position in which the engagement element engages with the guide member of the elevator system and a disengaged position in which it does not engage with the guide member. At least two permanent magnets are arranged in a configuration generating a repulsive force between the at least two permanent magnets and urging the engagement element towards the engaged position. The actuation mechanism further comprises at least one electric coil which is configured for generating an electromagnetic force urging the engagement element towards the disengaged position and/or for holding the engagement element in the disengaged position, when an electric current is flowing through the at least one electric coil.

Exemplary embodiments of the invention also include an elevator safety gear comprising a braking device and an actuation device according to an exemplary embodiment of the invention. The braking device is configured for braking the movement of the elevator car and/or counterweight by engaging a braking element, which usually is not identical with the engagement element of the actuation device, with a guide member of the elevator system. The braking device is mechanically coupled with the actuation device for being actuated, i.e. for being brought into a braking configuration in which it brakes the movement of the elevator car, by the actuation device.

Exemplary embodiments of the invention further include an elevator car and/or a counterweight for an elevator system, respectively comprising at least one elevator safety gear with an actuation device according to an exemplary embodiment of the invention.

Exemplary embodiments of the invention also include an elevator system comprising at least one elevator car according to an exemplary embodiment of the invention and/or at least one counterweight according to an exemplary embodiment of the invention.

In an actuation mechanism according to an exemplary embodiment of the invention, the engagement element is urged towards its engaged position by the magnetic forces of permanent magnets.

Thus, no elastic mechanical element, such as a spring, is necessary for urging the engagement element towards the engagement position. Thus, the specific problems of elastic mechanical elements, such as wear, contamination and fatigue, are avoided. In consequence, a reliable actuation mechanism having a long service life and needing only little maintenance is provided.

A number of optional features are set out in the following. These features may be realized in particular embodiments, alone or in combination with any of the other features, unless specified otherwise.

The electromagnetic force generated by the at least one electric coil may be an attractive force attracting the engagement element towards the at least one electric coil against the repulsive force generated by the permanent magnets.

The actuation mechanism may comprise at least two electric coils. The actuation mechanism in particular may comprise a first electric coil configured for moving the engagement element towards the disengaged position and a second electric coil configured for holding the engagement element in the disengaged position. As less force is needed for holding the engagement element than for moving the engagement element, the second electric coil may be adapted to a smaller electric current than the first electric coil. Using a smaller electric current allows saving electrical energy when the engagement element is only held but not moved, which is the normal state of the actuation mechanism. The second coil may have fewer windings than the first coil.

The electric coils may be arranged coaxially with each other resulting in a space-saving arrangement of the electric coils.

The at least two permanent magnets may include at least one permanent magnet which is arranged so that an axis extending between the north-pole and the south-pole of said permanent magnet is oriented parallel to the moving direction of the engagement element generating a magnetic force oriented parallel to the moving direction of the engagement element.

Said at least one permanent magnet in particular may be arranged within the at least one electric coil with the axis of said at least one permanent magnet being oriented parallel to, in particular coaxially with, an axis of the electric coil. Such an arrangement allows efficiently compensating the magnetic force of the at least one permanent magnet by an opposing electromagnetic force generated by an electric current flowing through the electric coil.

The at least two permanent magnets may include at least one permanent magnet arranged so that an axis extending between the north pole and the south pole of said permanent magnet is oriented transversely or orthogonally to a moving direction of the engagement element. Such an orientation of the permanent magnet allows an efficient magnetization of a yoke, in particular of a ring-shaped yoke arranged next to or around the at least one permanent magnet.

The actuation mechanism may comprise a stationary element or yoke housing the at least one electric coil and supporting or being formed integrally with at least one of the permanent magnets.

The actuation mechanism may comprise a movable element or yoke supporting or being formed integrally with the engagement element and supporting or being formed integrally with at least one of the permanent magnets.

The elements or yokes in particular may be configured for concentrating the magnetic forces generated by the electric coil and/or by the at least one of the permanent magnet towards the other element or yoke. Concentrating the magnetic forces enhances the efficiency of the actuation mechanism.

At least one of the elements or yokes may have a circular cross-section, in particular a circular cross-section in a plane extending perpendicularly to a moving direction of the engagement element. A circular cross-section allows for an efficient and space-saving arrangement of the electric coil and/or of the permanent magnets. At least one of the permanent magnets may have the shape of a ring or a doughnut matching the circular cross-section of the at least one element or yoke.

Based on the respective circumstances, other geometries may be employed as well.

At least one of the elements or yokes may comprise a cavity, groove or slot configured for accommodating the at least one electric coil and/or at least one of the permanent magnets. A cavity, groove or slot allows arranging the electric coil easily within the respective element or yoke.

DRAWING DESCRIPTION

In the following, exemplary embodiments of the invention are described in more detail with respect to the enclosed figures:

FIG. 1 schematically depicts an elevator system with an elevator safety gear according to an exemplary embodiment of the invention.

DETAILED DESCRIPTION

Figure 1:
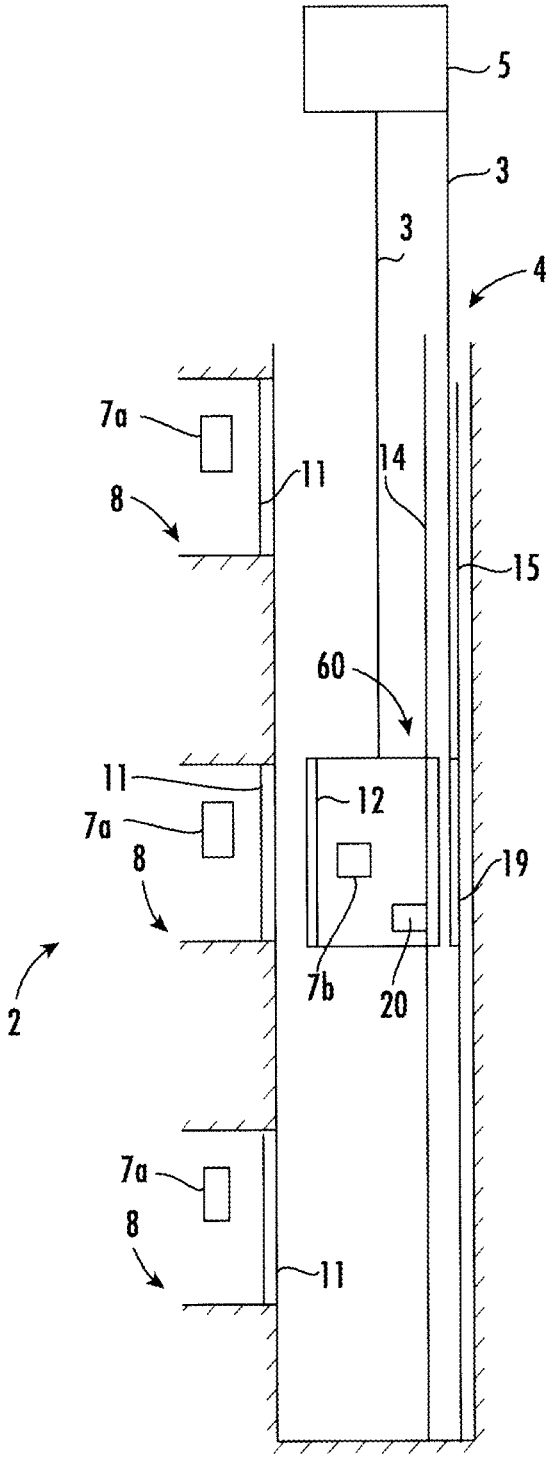

FIG. 1 schematically depicts an elevator system 2 according to an exemplary embodiment of the invention.

The elevator system 2 includes an elevator car 60 movably arranged within a hoistway 4 extending between a plurality of landings 8. The elevator car 60 in particular is movable along a plurality of car guide members 14, such as guide rails, extending along the vertical direction of the hoistway 4. Only one of said car guide members 14 is visible in FIG. 1.

Although only one elevator car 60 is depicted in FIG. 1, the skilled person will understand that exemplary embodiments of the invention may include elevator systems 2 having a plurality of elevator cars 60 moving in one or more hoistways 4.

The elevator car 60 is movably suspended by means of a tension member 3. The tension member 3, for example a rope or belt, is connected to a drive unit 5, which is configured for driving the tension member 3 in order to move the elevator car 60 along the height of the hoistway 4 between the plurality of landings 8, which are located on different floors.

Each landing 8 is provided with a landing door 11, and the elevator car 60 is provided with a corresponding elevator car door 12 for allowing passengers to transfer between a landing 8 and the interior of the elevator car 60 when the elevator car 60 is positioned at the respective landing 8.

The exemplary embodiment of the elevator system 2 shown in FIG. 1 employs a 1:1 roping for suspending the elevator car 60. The skilled person, however, easily understands that the type of the roping is not essential for the invention and that different kinds of roping, e.g. a 2:1 roping, may be used as well. The elevator system 2 may have a machine room or may be a machine room-less elevator system. The elevator system 2 may use a tension member 3, as it is shown in FIG. 1, or it may be an elevator system without a tension member 3. The drive 5 may be any form of drive used in the art, e.g. a traction drive, a hydraulic drive or a linear drive.

The elevator system 2 shown in FIG. 1 further includes a counterweight 19 attached to the tension member 3 and moving concurrently and in opposite direction with respect to the elevator car 6 along at least one counterweight guide member 15. The skilled person will understand that the invention may be applied also to elevator systems 2 which do not comprise a counterweight 19.

The tension member 3 may be a rope, e.g. a steel wire rope, or a belt. The tension member 3 may be uncoated or may have a coating, e.g. in the form of a polymer jacket. In a particular embodiment, the tension member 3 may be a belt comprising a plurality of polymer coated steel cords (not shown). The elevator system 2 may have a traction drive including a traction sheave for driving the tension member 3.

The drive unit 5 is controlled by an elevator control unit (not shown) for moving the elevator car 60 along the hoistway 4 between the different landings 8.

Input to the control unit may be provided via landing control panels 7*a*, which are provided on each landing 8 close to the landing doors 11, and/or via an elevator car control panel 7*b*, which is provided inside the elevator car 60.

The landing control panels 7*a* and the elevator car control panel 7*b* may be connected to the elevator control unit by means of electric wires, which are not shown in FIG. 1, in particular by an electric bus, such as a field bus/CAN-bus, or by means of wireless data connections.

The elevator car 60 is equipped with at least one elevator safety gear 20, which is illustrated schematically at the elevator car 60. Alternatively or additionally, the counterweight 19 may be equipped with at least one elevator safety gear 20. An elevator safety gear 20 attached to the counterweight 19, however, is not shown in FIG. 1.

The elevator safety gear 20 is operable to brake or at least assist in braking (i.e. slowing or stopping the movement) of the elevator car 60 relative to a car guide member 14 by engaging with the car guide member 14. In the following, the structure and the operating principle of an elevator safety gear 20 according to an exemplary embodiment of the invention will be described.

Figure 2:
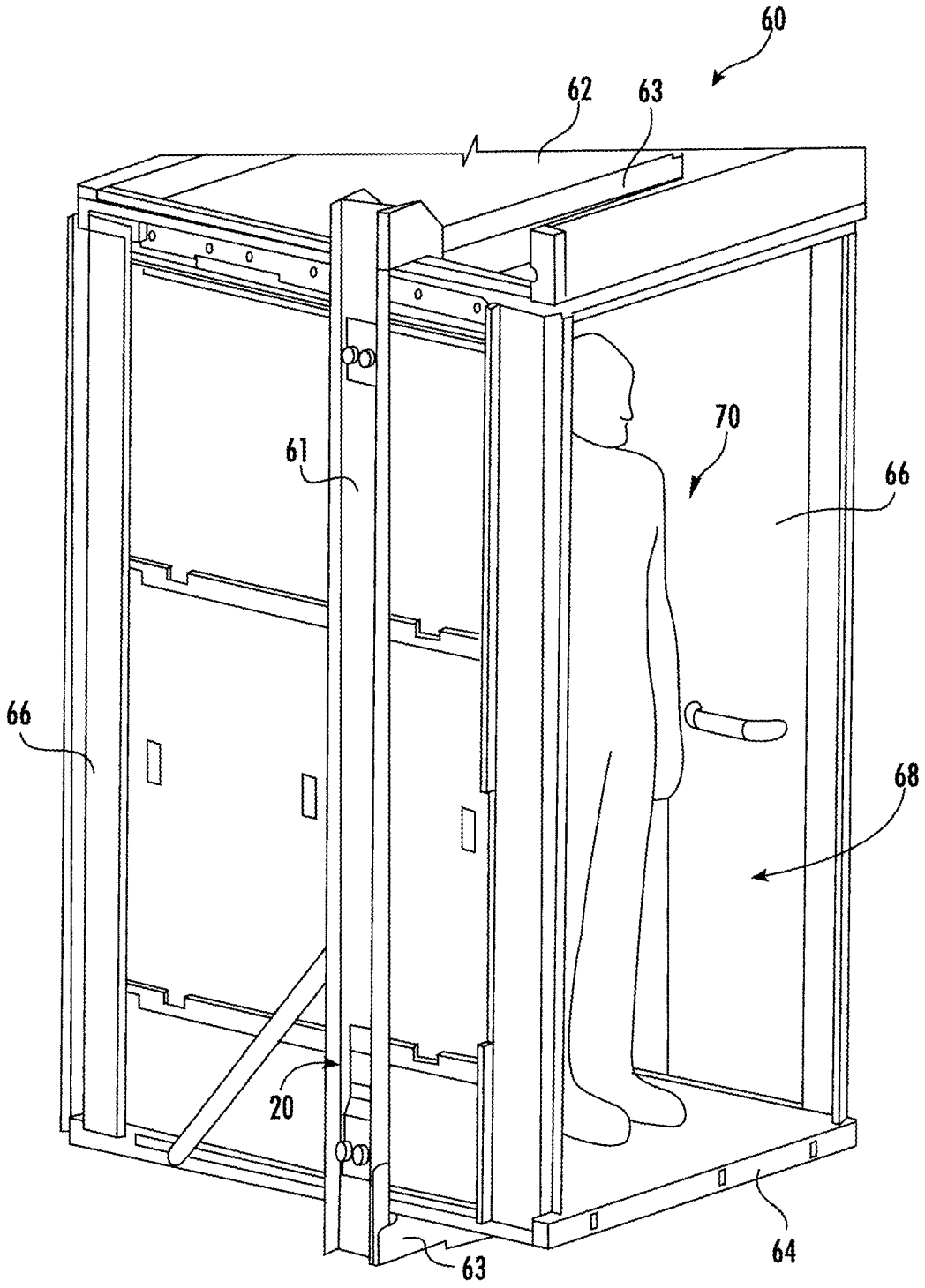
FIG. 2 shows a perspective view of an elevator car comprising an elevator safety gear according to an exemplary embodiment of the invention.

FIG. 2 is an enlarged perspective view of an elevator car 60 according to an exemplary embodiment of the invention. The elevator car 60 comprises a structural frame comprising vertically extending uprights 61 and crossbars 63 extending horizontally between the uprights 61. Only one upright 61 is visible in FIG. 2.

The elevator car 60 further includes a car roof 62, a car floor 64 and a plurality of car side walls 66. In combination, the car roof 62, the car floor 64 and the plurality of side walls 66 define an interior space 68 for accommodating and carrying passengers 70 and/or cargo (not shown).

An elevator safety gear 20 according to an exemplary embodiment of the invention is attached to an upright 61 of the elevator car 60.

Although only one elevator safety gear 20 is depicted in FIGS. 1 and 2, respectively, the skilled person will understand that a plurality of safety gear assemblies 20 may be mounted to a single elevator car 60. In particular, in a configuration in which the elevator system 2 comprises a plurality of car guide members 14, an elevator safety gear 20 may be associated with each car guide member 14.

Alternatively or additionally, two or more elevator safety gears 20 may be provided on top of each other at the same upright 61 of the elevator car 60 in order to engage with the same car guide member 14.

Figure 3:
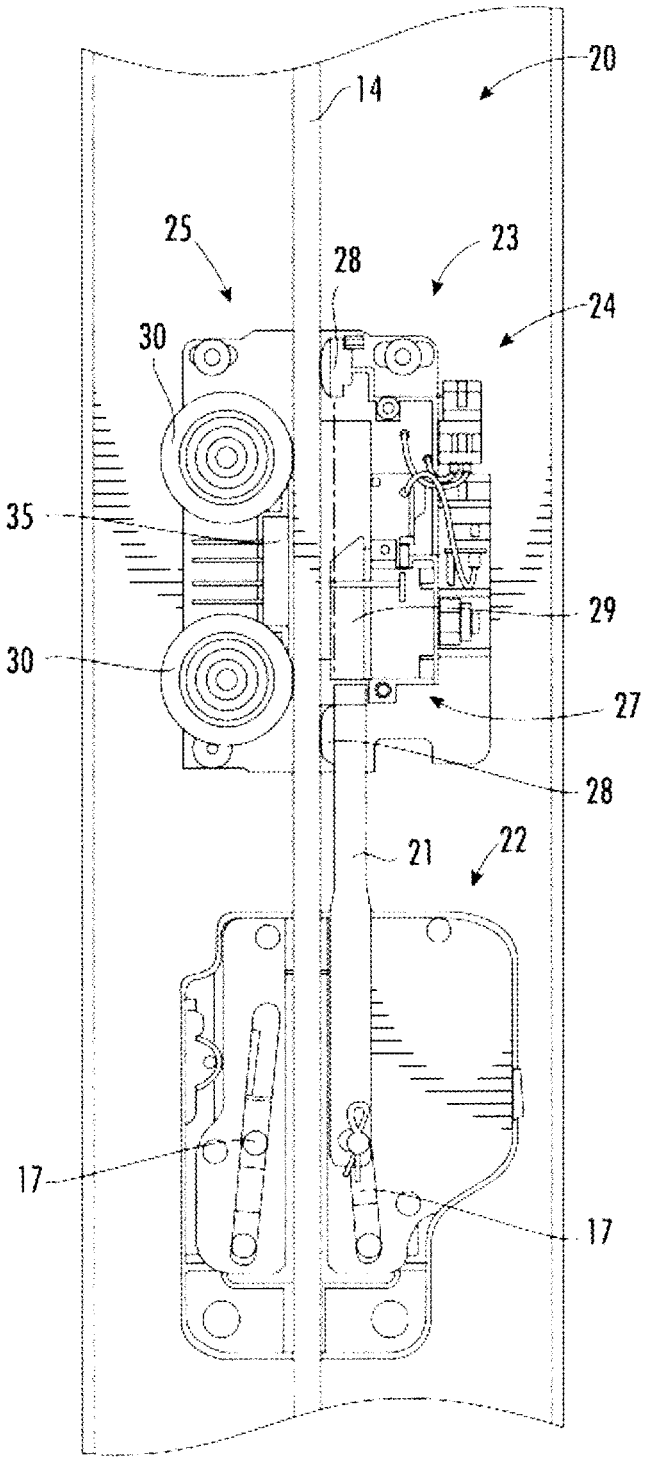
FIG. 3 shows a plane view of an elevator safety gear according to an exemplary embodiment of the invention.
Figure 4:
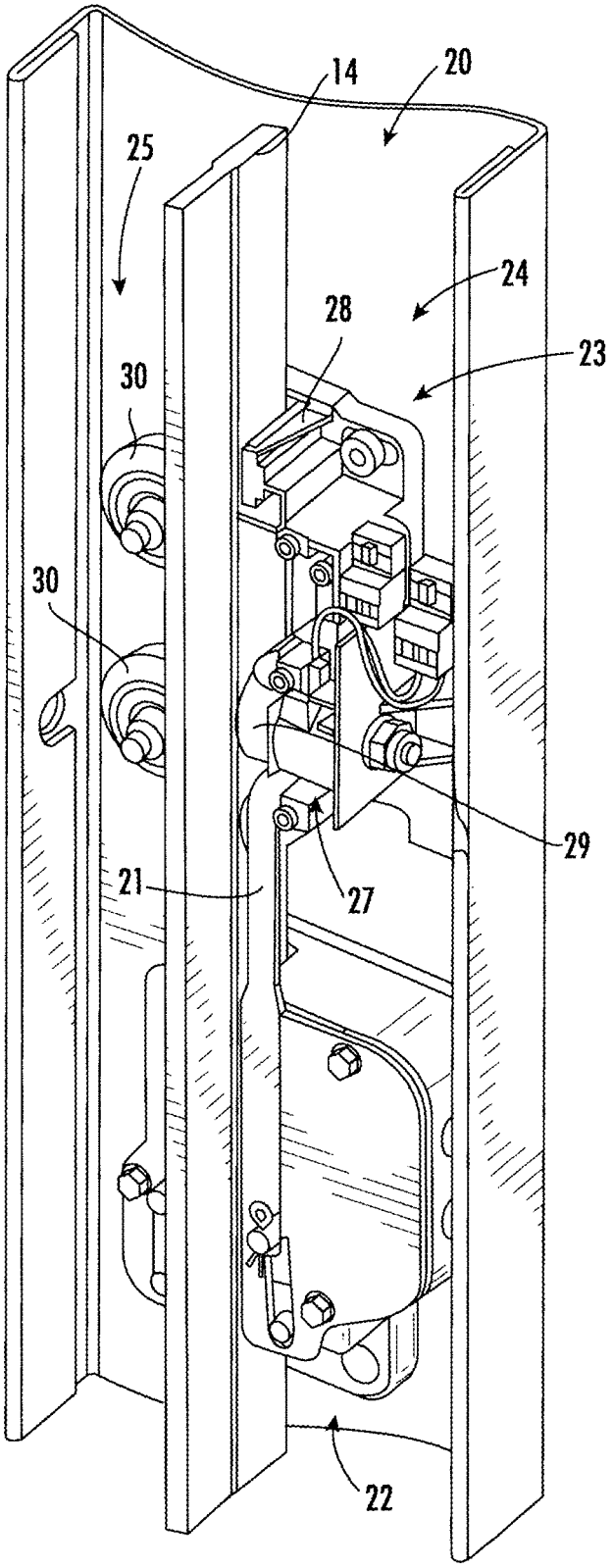
FIGS. 4 and 5 show perspective views of the elevator safety gear shown in FIG. 3, respectively.
Figure 5:
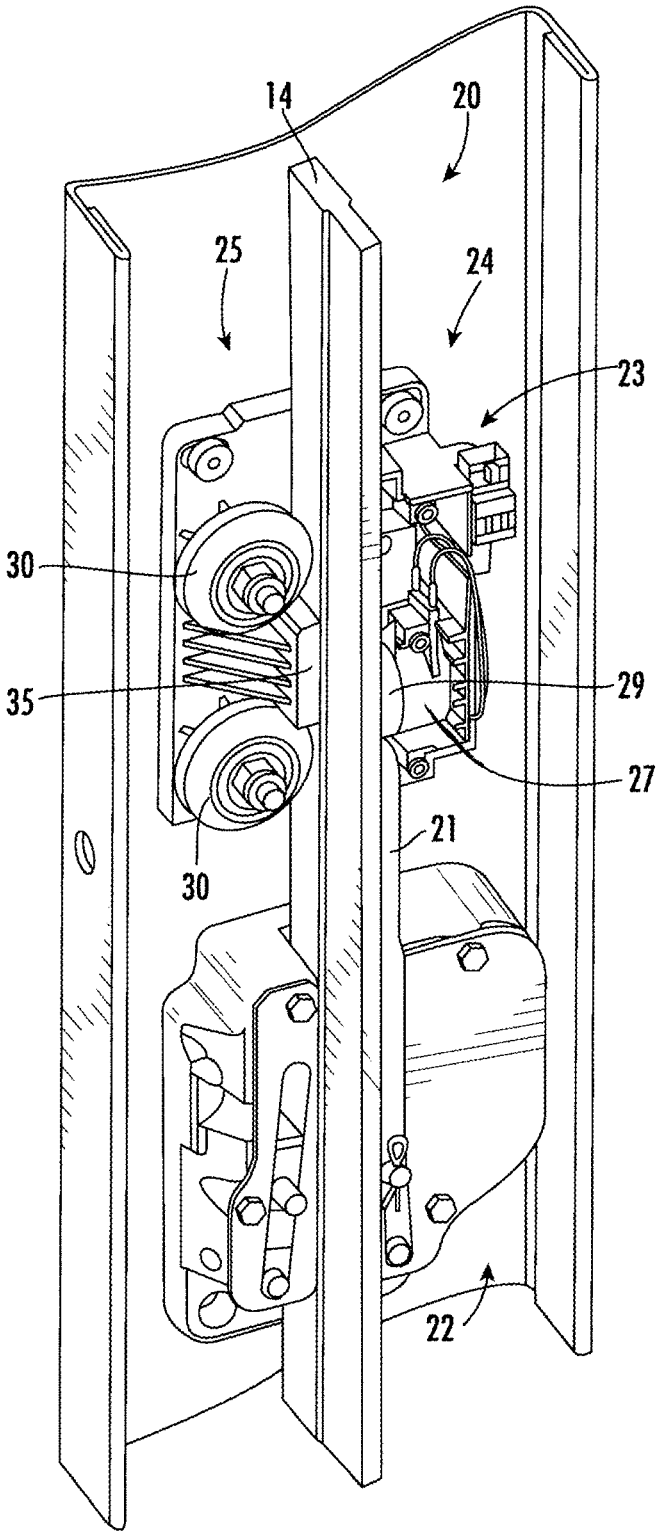

An elevator safety gear 20 according to an exemplary embodiment of the invention is depicted in more detail in FIGS. 3 to 5. FIG. 3 shows a plane view of the elevator safety gear 20. FIGS. 4 and 5 show perspective views of the elevator safety gear 20 from two different angles.

The elevator safety gear 20 comprises a braking device 22 and an actuation device 24. The braking device 22 comprises at least one braking member 17 configured for engaging with the car guide member 14 in order to brake the movement of the elevator car 60 along the car guide member 14. The braking device 22 is of the self-locking type, e.g. employing a wedge-type construction of the at least one braking member 17.

In the embodiment depicted in FIG. 3, the braking device 22 and the actuation device 24 are spaced apart from each other in a longitudinal (vertical) direction along the car guide member 14. However, other arrangements of the braking device 22 and the actuation device 24 are possible as well. The braking device 22 and the actuation device 24 in particular may be integrated with each other forming a combined actuation and braking device.

The braking device 22 and the actuation device 24 are mechanically coupled with each other by an actuation rod 21 extending along the longitudinal direction, i.e. parallel to the car guide member 14. The actuation device 24 is configured for actuating the braking device 22 via the actuation rod 21.

The braking device 22 is not discussed in more detail here. An example of a self-locking braking device 22 as it may be employed in an elevator safety gear 20 according to an exemplary embodiment of the invention is described in detail in the European patent application 17 192 555.5 which in its entirety is incorporated herein by reference.

The actuation device 24 comprises a first member 23 shown on the right side of FIGS. 3 to 5, and a second member 25 shown on the left side of FIGS. 3 to 5, respectively. The first and second members 23, 25 are arranged opposite to each other defining a gap. The car guide member 14 extends through said gap in the longitudinal direction.

The first and second members 23, 25 are rigidly connected with each other so that they are not movable with respect to each other. The first and second members 23, 25 in particular may be formed integrally with each other representing two portions of the same element.

In the disengaged (released) state, the braking device 22 and the actuation device 24 do not engage with the car guide member 14. This allows the elevator safety gear 20 to move together with the elevator car 60 along the car guide member 14 in the longitudinal direction.

The first member 23 comprises a movable engagement element 29, which in particular is movable in a direction transverse to the longitudinal direction from its disengaged position into an engaged position. The engagement element 29 in particular may be movable in a horizontal direction, i.e. orthogonally to the longitudinal direction. When arranged in the engaged position, the engagement element 29 engages with the car guide member 14. The friction between the car guide member 14 and the engagement element 29 arranged in the engaged position generates a force acting onto the actuation rod 21 activating the braking device 22.

The actuation device 24 comprises an activation mechanism 27 configured for activating the actuation device 20 by causing the engagement element 29 to move from its disengaged position into an engaged position in which it engages with the car guide member 14.

In the embodiment shown in FIGS. 3 to 5, the activation mechanism 27 is provided at the first member 23. The details of the activation mechanism 27 will be discussed further below with reference to FIGS. 9 and 10.

The first member 23 comprises two stopper elements 28 spaced apart from each other in the longitudinal direction. The engagement element 29 is arranged between the two stopper elements 23.

The second member 25 supports two rollers 30. When the elevator safety gear 20 moves along the car guide member 14 in the longitudinal direction, the rollers 30 are configured for rolling along the guide member 14 extending through the gap.

The rollers 30 reduce the friction between the elevator safety gear 20, in particular the second member 25, and the car guide member 14 when the actuation device 24 is not activated.

The rollers 30 may be made at least partially from a synthetic material, in particular a durable material, which allows for a low friction between the car guide member 14 and the rollers 30. The rollers 30 in particular may be made at least partially from a rubber material. Further, more or less than two rollers 30 may be used.

Figure 6:
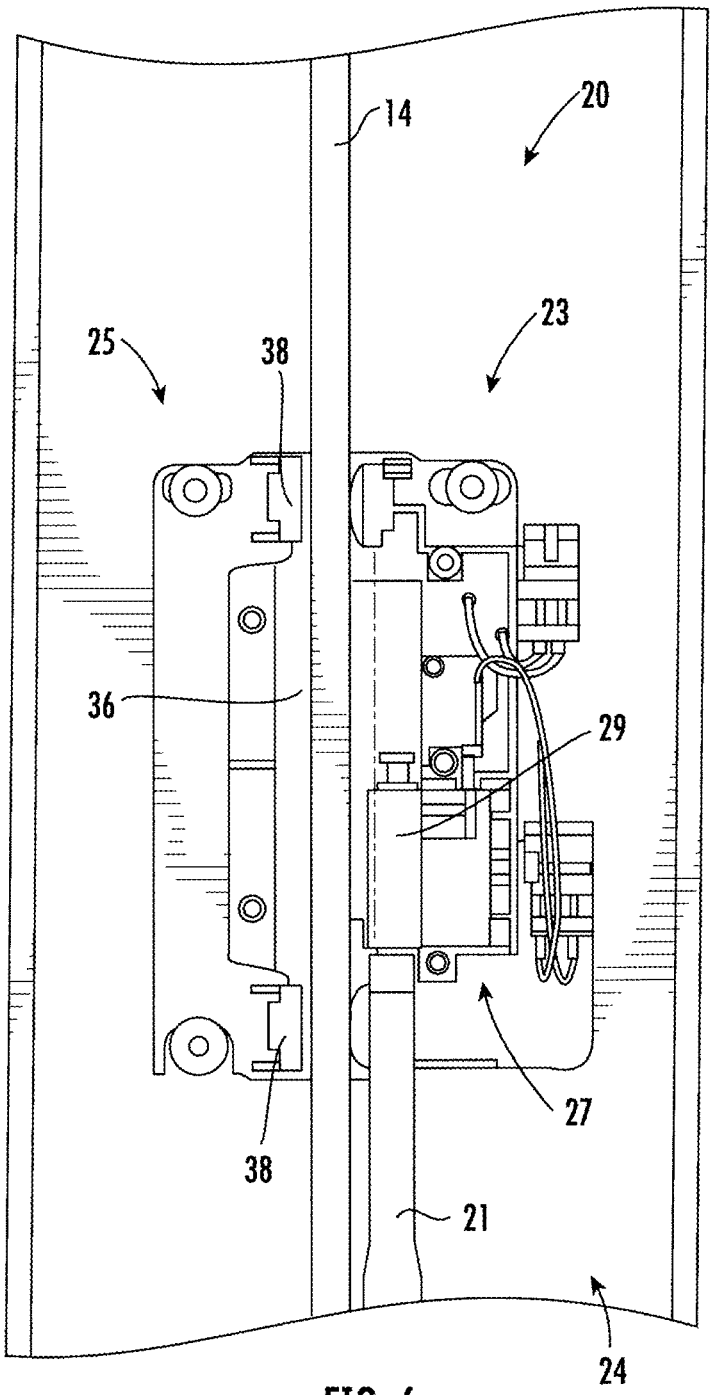
FIG. 6 shows a plane view of an elevator safety gear according to another exemplary embodiment of the invention.
Figure 7:
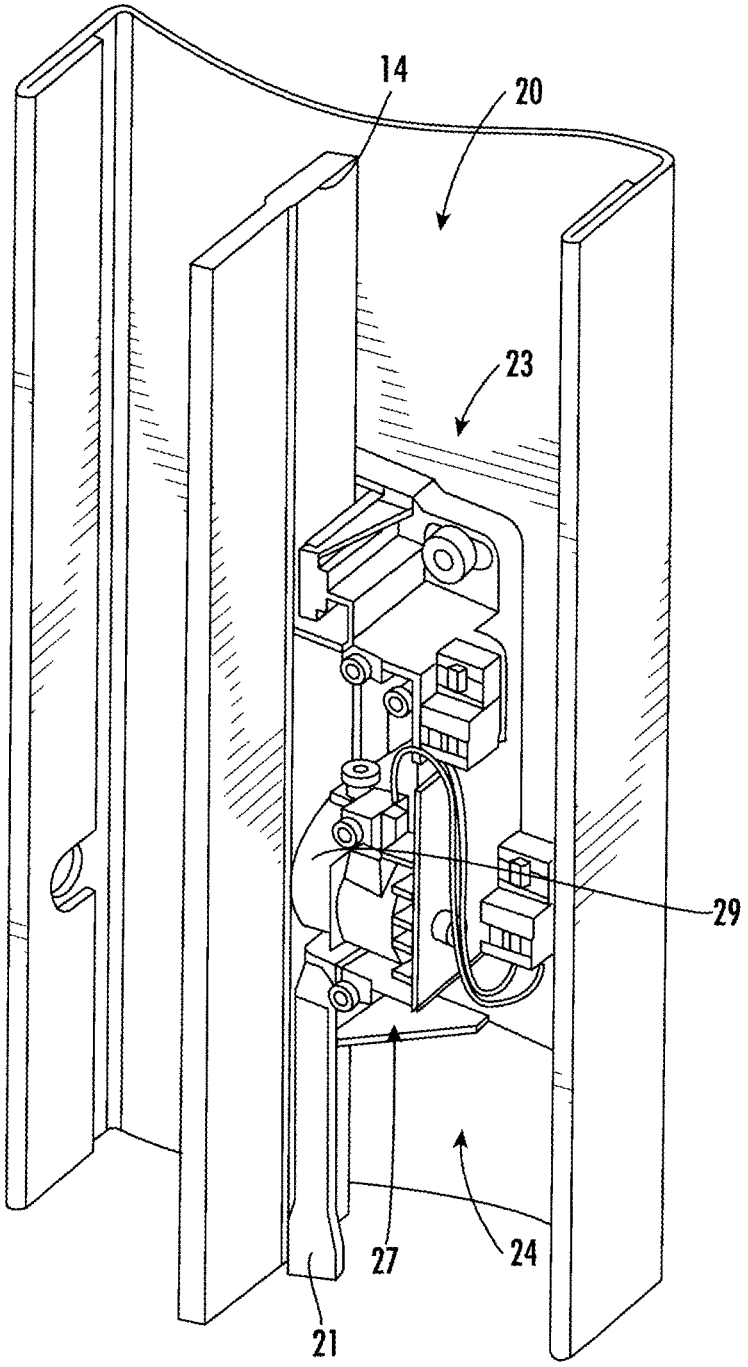
FIGS. 7 and 8 show perspective views of the elevator safety gear shown in FIG. 6, respectively.
Figure 8:
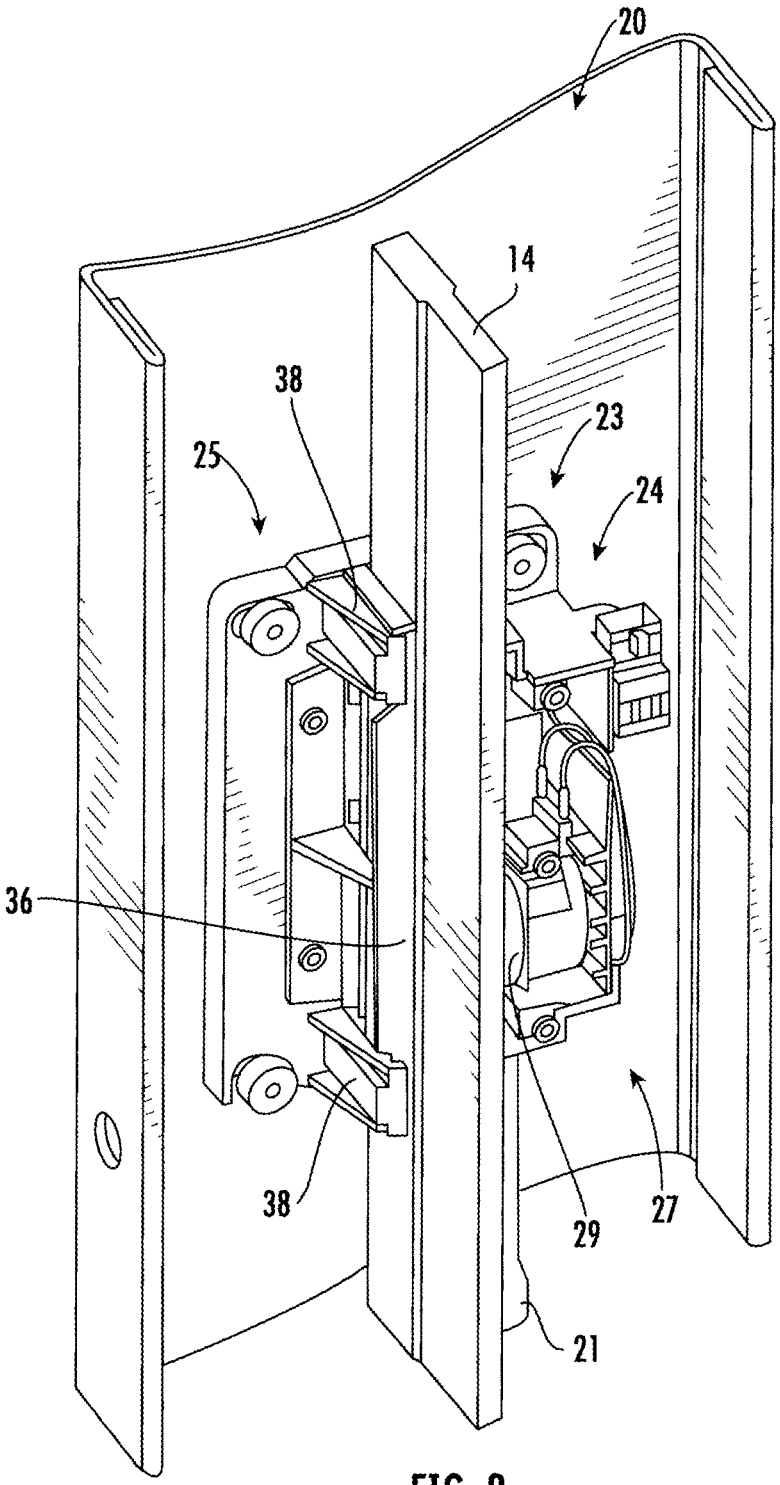

An elevator safety gear 20 according to another exemplary embodiment of the invention is depicted in FIGS. 6 to 8. FIG. 6 shows a plane view of the elevator safety gear 20. FIGS. 7 and 8 show perspective views from two different angles, respectively.

Only the car guide member 14, the actuation device 24 and the activation rod 21 are depicted in FIGS. 6 to 8, i.e. the braking device 22, which may be identical to the braking device depicted in FIGS. 3 to 5, is not shown.

Similar to the embodiment depicted in FIGS. 3 to 5, the actuation device 24 comprises a first member 23 and a second member 25 forming a gap in between, and the car guide member 14 extends through said gap.

The first member 23 is identical with the first member 23 of the embodiment depicted in FIGS. 3 to 5. It therefore is not discussed in detail again. Reference is made to the respective description of FIGS. 3 to 5. In the following, only the differences between the two embodiments are described.

In the embodiment depicted in FIGS. 6 to 8, the second member 25 does not comprise rollers 30. Instead, the second member 25 comprises a low friction element 36 extending in the longitudinal direction parallel to the car guide member 14.

For reducing the friction between the second member 25 and the car guide member 14 the surface of the low friction element 36 facing the car guide member 14 is provided as a low friction surface.

In particular, a coating having a low friction coefficient, e.g. a coating based on at least one of polytetrafluoroethylene (PTFE), graphite, polyethylene (PE), ultra-high molecular weight polyethylene (UHMWPE), graphene, polyether ether ketone (PEEK), may be applied to the surface of the low friction element 36 facing the car guide member 14.

In the embodiment depicted in FIGS. 6 to 8, the second member 25 comprises two support elements 38 which are spaced apart from each other in the longitudinal direction. The low friction element 36 is attached to and extends in between said support elements 38.

In order to allow for an easy replacement of the low friction element 36, the low friction element 36 may be attached to support elements 38 using a fixing mechanism which allows for easily detaching the low friction element 36 from the support elements 38. The fixing mechanism in particular may be a snap-on/clamping mechanism.

The use of two support elements 38 is only exemplarily and more or less than two support elements 38 may be used. Similarly, more than one low friction element 36 may be employed.

Figure 9:
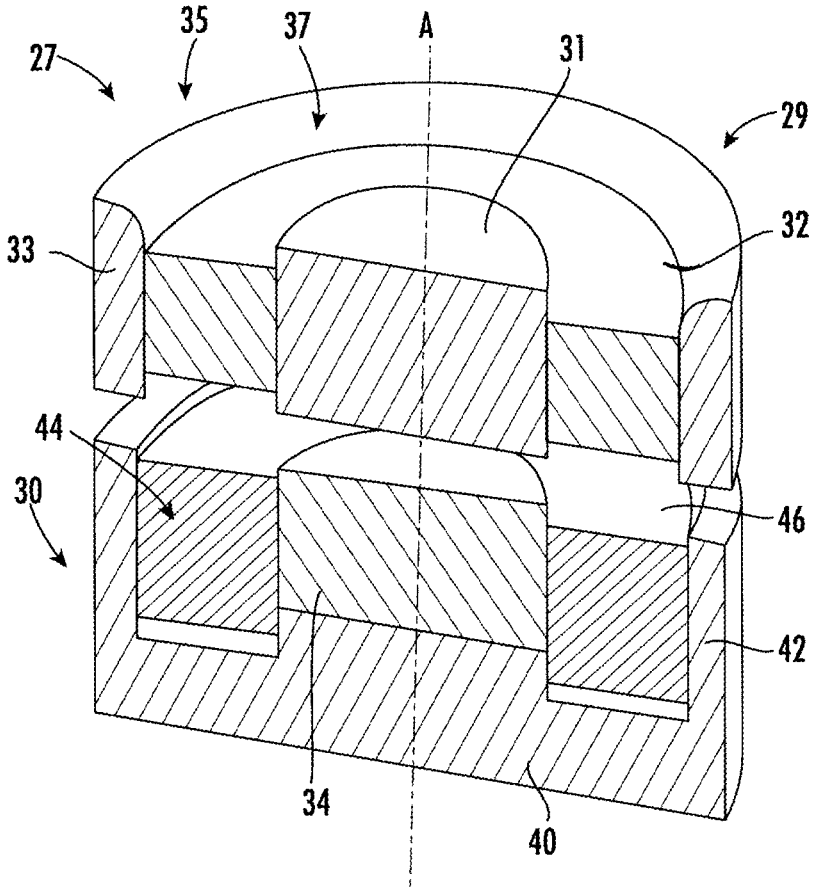
FIG. 9 shows a perspective sectional view of an actuation mechanism according to an exemplary embodiment of the invention.

FIG. 9 shows a perspective schematic sectional view of an actuation mechanism 27 according to an exemplary embodiment of the invention.

The actuation mechanism 27 comprises the engagement element 29 and a stationary actuation member 30. The actuation member 30 is securely attached to the first member 23, which is not shown in FIG. 9.

The engagement element 29 is movable with respect to the actuation member 30 along an axis A between an engaged position, in which the engagement element 29 engages with the guide member 14 (not shown in FIG. 9), and a disengaged position, in which the engagement element 29 does not engage with the guide member 14.

In the embodiment depicted in FIG. 9, the engagement element 29 and the actuation member 30 both have a cylindrical shape around the axis A. The engagement element 29 and the actuation member 30 have basically the same radius with respect to axis A.

A first, ring-shaped, permanent magnet (movable permanent magnet) 32 is arranged within the engagement element 29 in a cavity 37 formed between a cylindrical metallic core 31 provided at the center of the engagement element 29 and a circular outer circumferential wall 33. The cylindrical metallic core 31 and the outer circumferential wall 33, in combination, constitute a movable yoke 35.

A second, cylindrical shaped, permanent magnet (stationary permanent magnet) 34 is provided at the center of the actuation member 30.

Axis A extends through the center of the first and second permanent magnets 32, 34, respectively.

The actuation member 30 further includes a metallic stationary yoke 40 having a circular circumferential outer wall 42. A circular groove 44 accommodating a ring-shaped electric coil 46 is formed in the stationary yoke 40 between the circumferential outer wall 42 and the stationary permanent magnet 34.

Although in the exemplary embodiment depicted in FIG. 9 each of the engagement element 29, the actuation member 30, the permanent magnets 32, 34, and the electric coil 46 has a circular cross-section, respectively, the skilled person understands that this is only exemplarily and that other geometrical shapes may be employed as well. The geometrical shapes of the engagement element 29, the actuation member 30, the permanent magnets 32, 34, and the electric coil 46 in particular may be adapted to the specific geometry of the actuation device 24 in which they are employed.

Figure 10:
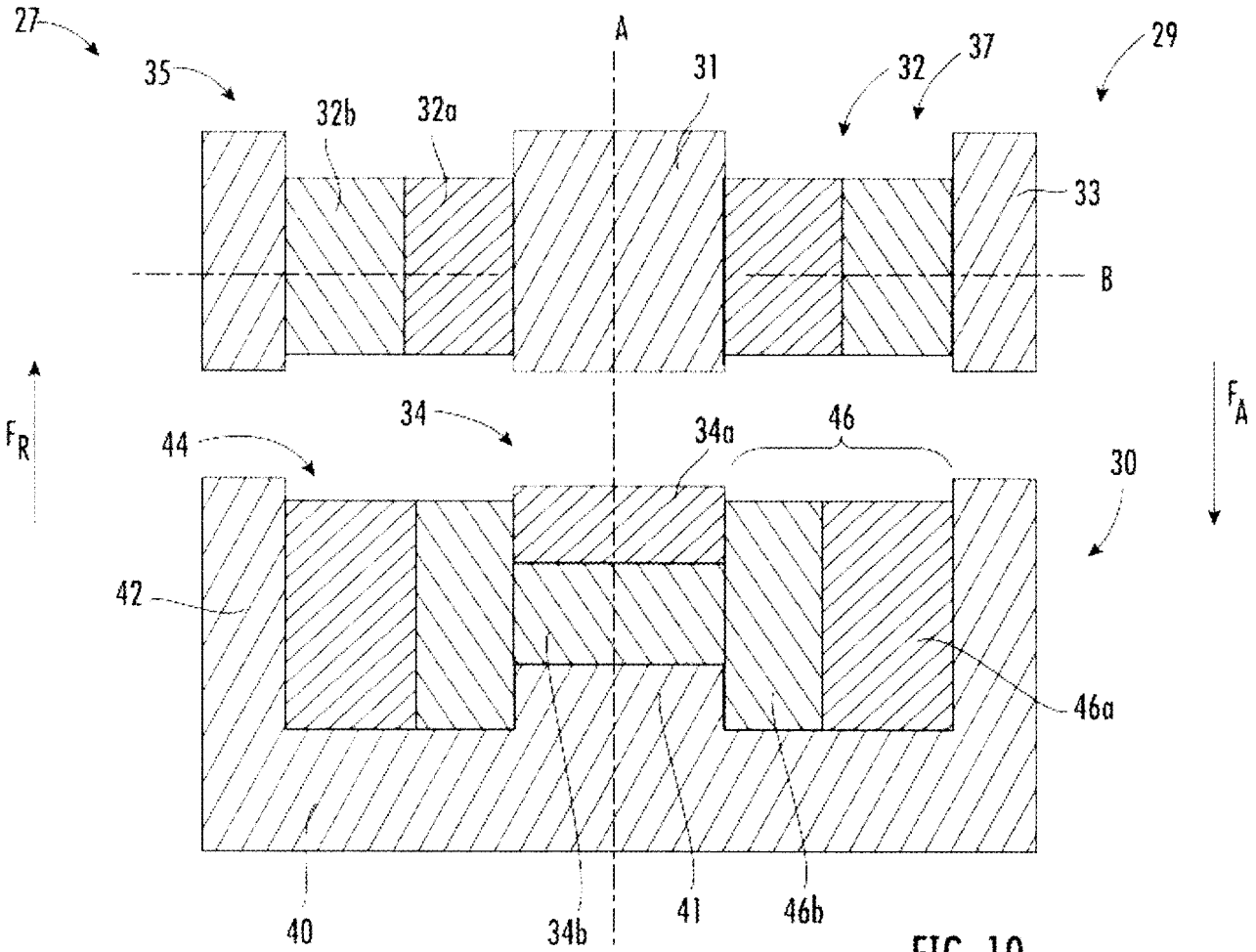
FIG. 10 shows a planar sectional view of the actuation mechanism shown in FIG. 9.

FIG. 10 depicts a sectional view of the engagement element 29 and the actuation member 30 of the actuation mechanism 27 shown in FIG. 9. The features which have been discussed with reference to FIG. 9 are denoted with the same reference signs and will not be discussed in detail again.

In FIG. 10, the poles 32*a*, 32*b*, 34*a*, 34*b* of the permanent magnets 32, 34 are visualized by different hatchings.

FIG. 10 shows that the ring-shaped movable permanent magnet 32 is magnetized in a radial direction, i.e. an axis B extending between the poles 32*a*, 32*b* of the movable permanent magnet 32 extends in the radial direction orthogonally to the axis A, with a first pole 32*a* facing the cylindrical metallic core 31 at the center of the engagement element 29, and an opposing second pole 32*b* facing the outer circumferential wall 33 of the engagement element 29.

The stationary permanent magnet 34 arranged at the center of the actuation member 30 is magnetized parallel to axis A, i.e. orthogonally to a plane in which the movable permanent magnet 32 extends. A first pole 34*a* of the stationary permanent magnet 34 faces the cylindrical metallic core 31 of the engagement element 29, and an opposing second pole 34*b* faces a center portion 41 of the stationary yoke 40.

The permanent magnets 32, 34 are oriented such that poles 32*a*, 32*b*, 34*a*, 34*b* of the same kind, i.e. two north-poles or two south-poles, are oriented towards the core 31 of the engagement element 29 generating a repulsive force $F_R$ between the two yokes 35, 40 urging the engagement element 29 away from the actuation member 30 and towards the guide member 14, which is not shown in FIGS. 9 and 10. In the orientation of the activation mechanism 27 as it is depicted in FIGS. 9 and 10, the repulsive force $F_R$ urges the engagement element 29 upwards.

In the exemplary embodiment depicted in FIG. 10, the ring-shaped electric coil 46 provided in the groove 44 formed between the stationary permanent magnet 34 and the circular outer wall 42 of the stationary yoke 40 includes two electric coils 46*a*, 46*b*. The ring-shaped electric coil 46 in particular includes an outer electric coil 46*a* and an inner electric coil 46*b*. Both electric coils 46*a*, 46*b* are coaxially wound around the axis A. The inner electric coil 46*b* is arranged inside the outer electric coil 46*a* in the radial direction, i.e. between the outer electric coil 46*a* and the stationary permanent magnet 34.

When an electric current is flowing through, both electric coils 46*a*, 46*b* are configured for generating an electromagnetic field, which, when interacting with the movable permanent magnet 32, results in an attractive electromagnetic force $F_A$ acting against the repulsive force $F_R$ generated by the interaction of the permanent magnets 32, 34.

I.e. by flowing a sufficiently large electric current through at least one of the electric coils 46*a*, 46*b*, the engagement element 29 may be moved from its engaged position towards a disengaged position, in which the engagement element 29 does not contact the guide member 14. By flowing a smaller electric current through at least one of the electric coils 46*a*, 46*b*, the engagement element 29 may be held in said disengaged position allowing the elevator car 60 to move freely along the guide member 14.

In the embodiment depicted in FIG. 10, the outer electric coil 46*a* is configured for moving the engagement element 29 from its engaged position towards the disengaged position; and the inner electric coil 46*b* is configured for holding the engagement element 29 in the disengaged position. As a smaller force is necessary for holding the engagement element 29 than for moving the engagement element 29, the inner electric coil 46*b*, which is configured for holding the engagement element 29 in the disengaged position, may be smaller and/or comprise fewer windings than the outer electric coil 46*b*, which is configured for moving the engagement element 29 from its engaged position towards the disengaged position.

During normal operation of the elevator system 2 an electrical current flowing through the inner electric coil 46*b* generates an attractive electromagnetic force $F_A$ counterbalancing the repulsive force $F_R$ generated by the permanent magnets 32, 34 for holding the engagement element 29 in a disengaged position allowing free movement of the elevator car 60 along the guide member 14.

In an emergency situation, the electric current flowing through the inner electric coil 46*b* is switched-off. As a result, the engagement element 29 is urged by the repulsive force $F_R$ generated by the permanent magnets 32, 34 against the guide member 14 where it engages with said guide member 14 and, in consequence, activates the braking device 22 of the elevator safety gear 20 for braking the movement of the elevator car 60.

In order to allow the elevator car 60 to move again after the emergency situation has been overcome, an electrical current is caused to flow through the larger outer electric coil 46*a* or through both electric coils 46*a*, 46*b* for generating an electromagnetic attractive force $F_A$ which is sufficiently strong for moving the engagement element 29 against the repulsive force $F_R$ generated by the permanent magnets 32, 34 from its engaged position back into the disengaged position.

After the engagement element 29 has reached the disengaged position, the electrical current flowing though the larger electric coil 46*a* is switched off, and a (smaller) electric current is caused to flow only through the smaller electric coil 46*b* for holding the engagement element 29 in the disengaged position, in which the engagement element 29 does not activate the braking device 22 but allows the elevator car 60 to move freely along the guide member 14.

Although the exemplary embodiment depicted in FIG. 10 comprises two electric coils 46*a*, 46*b* dedicated for moving and holding the engagement element 29, respectively, the skilled person understands that providing two separate electric coils 46*a*, 46*b* is not mandatory, but that a simplified actuation mechanism 27 comprising only a single electric coil 46*a*, 46*b* may be used as well. Similarly, a configuration comprising more than two electric coils 46*a*, 46*b* may be employed.

Further, although only elevator safety gears 20 mounted to an elevator car 60 have been described with reference to the figures, the skilled person understands that an actuation device 24 according to an exemplary embodiment of the invention similarly may be employed in an elevator safety gear 20 which is mounted to a counterweight 19 of an elevator system 2.

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention shall not be limited to the particular embodiment disclosed, but that the invention includes all embodiments falling within the scope of the dependent claims.

REFERENCES

2 elevator system
3 tension member
4 hoistway
5 drive unit
7*a* landing control panel
7*b* elevator car control panel
8 landing
11 landing door
12 elevator car door
14 car guide member
15 counterweight guide member
17 braking member
19 counterweight
20 elevator safety gear
21 actuation rod
22 braking device
23 first member
24 actuation device
25 second member
27 activation mechanism
28 stopper element
29 engagement element
30 actuation member
31 core of the engagement element
32 first/movable permanent magnetic
33 outer circumferential wall of the engagement element
34 second/stationary permanent magnetic
35 movable yoke
36 low friction element
37 cavity within the engagement element
38 support element
40 stationary yoke
41 center portion
42 circumferential outer wall of the yoke
44 groove
46 electric coil
46*a* outer electric coil
46*b* inner electric coil
60 elevator car
61 upright
62 car roof
63 crossbar
64 car floor
66 car side wall
68 interior space of the elevator car
70 passenger

What is claimed is:

1. Actuation mechanism (27) for an elevator safety gear (20), the elevator safety gear (20) being configured for braking an elevator car (60) and/or a counterweight (19) of an elevator system (2) by engaging a braking member (17) with a guide member (14, 15) of the elevator system (2), wherein the actuation mechanism (27) comprises:

an engagement element (29), which is movable between an engaged position in which it engages with the guide member (14, 15) of the elevator system (2) and a disengaged position in which it does not engage with the guide member (14, 15) of the elevator system (2);

at least two permanent magnets (32, 34) arranged in a configuration generating a repulsive force ($F_R$) between the at least two permanent magnets (32, 34) and urging the engagement element (29) towards the engaged position, wherein one of the at least two permanent magnets is a stationary permanent magnet and the other of the at least two permanent magnets is movable relative to the stationary permanent magnet; and at least one electric coil (46, 46*a*, 46*b*) configured for generating an electromagnetic force urging the engagement element (29) towards the disengaged position and/or for holding the engagement element (29) in the disengaged position, when an electric current is flowing through the at least one electric coil (46, 46*a*, 46*b*), wherein the at least one electric coil is positioned to radially overlap the stationary permanent magnet.

2. Actuation mechanism (27) according to claim 1, wherein the electromagnetic force generated by the at least one electric coil (46, 46*a*, 46*b*) is an attractive electromagnetic force ($F_A$) attracting the engagement element (29) towards the at least one electric coil (46, 46*a*, 46*b*).

3. Actuation mechanism (27) according to claim 1, comprising at least two electric coils (46*a*, 46*b*), in particular a first electric coil (46*a*) configured for moving the engagement element (29) into the disengaged position and a second electric coil (46*b*) configured for holding the engagement element (29) in the disengaged position.

4. Actuation mechanism (27) according to claim 3, wherein the electric coils (46*a*, 46*b*) are arranged coaxially with each other.

5. Actuation mechanism (27) according to claim 1, wherein the at least two permanent magnets (32, 34) include at least one permanent magnet (32) arranged so that an axis (A) extending between the poles (32*a*, 32*b*) of said permanent magnet (32) is oriented parallel to the moving direction of the engagement element (29).

6. Actuation mechanism (27) according to claim 5, wherein said at least one permanent magnet (32) is arranged within the at least one electric coil (46, 46*a*, 46*b*), wherein the axis (A) of said at least one permanent magnet (32) in particular is oriented parallel to, in particular coaxially with, an axis (A) of the coil (46, 46*a*, 46*b*).

7. Actuation mechanism (27) according to claim 1, wherein the at least two permanent magnets (32, 34) include at least one permanent magnet (34) arranged in a configuration in which an axis (B) extending between the poles (34*a*, 34*b*) of said permanent magnet (34) is oriented transversely or orthogonally to a moving direction of the engagement element (29).

8. Actuation mechanism (27) according to claim 1, comprising a stationary element (30) or yoke (40) housing the at least one electric coil (46, 46*a*, 46*b*) and supporting, or being formed integrally with, at least one of the permanent magnets (32, 34).

9. Actuation mechanism (27) according to claim 1, comprising a movable element (29) or yoke (35) supporting or being formed integrally with the engagement element (29) and supporting or being formed integrally with at least one of the permanent magnets (32, 34).

10. Actuation mechanism (27) according to claim 9, wherein at least one of the elements (29, 30) or yokes (35, 40) has a circular cross-section, in particular in a plane extending perpendicularly to a moving direction of the engagement element (29).

11. Actuation mechanism (27) according to claim 9, wherein at least one of the elements (29, 30) or yokes (35, 40) has a cavity (37) or groove (44) configured for accommodating the at least one electric coil (46, 46*a*, 46*b*) and/or at least one of the permanent magnets (32, 34).

12. Actuation mechanism (27) according to claim 1, wherein at least one of the permanent magnets (32, 34) has the shape of a ring or a doughnut.

13. Elevator safety gear (20), comprising:

an actuation mechanism (27) according to claim 1;

a braking device (22) configured for braking the elevator car (60) by engaging with the guide member (14, 15) of the elevator system (2); and wherein the actuation mechanism (27) is mechanically coupled with the braking device (22) allowing the actuation mechanism (27) to trigger the braking device (22) by engaging the engagement element (29) with a guide member (14, 15) of the elevator system (2).

14. Elevator system (2), comprising:

at least one elevator safety gear (20) according to claim 13;

the elevator car (60) configured for moving along the guide member (14) extending along a hoistway (4); and wherein the elevator safety gear (20) is attached to the counterweight (19) for braking the movement of the at least one elevator car (60).

* * * * *